US005301393A

United States Patent [19]

Brown

[11] Patent Number: 5,301,393

[45] Date of Patent: Apr. 12, 1994

[54] SPRING BIASED CLIP AND METHOD OF MAKING

[76] Inventor: Dwight C. Brown, 1516 N. Nicholas St., Arlington, Va. 22205

[21] Appl. No.: 780,289

[22] Filed: Oct. 22, 1991

Related U.S. Application Data

[63] Continuation-in-part of Ser. No. 587,029, Sep. 24, 1990, Pat. No. 5,079,808.

[51] Int. Cl.[5] ..... A44B 21/00

[52] U.S. Cl. ..... 24/67.7; 24/499; 24/511

[58] Field of Search ..... 24/67.7, 67.5, 67 R, 24/67.3, 489, 499, 501, 507, 510, 511, 498, 500

[56] References Cited

U.S. PATENT DOCUMENTS

| | | | |
|---|---|---|---|
| 2,525,985 | 10/1950 | Weymouth | 24/511 |
| 3,030,681 | 4/1962 | Phillips | 24/499 |
| 3,574,248 | 4/1971 | Gaglia | 24/511 |
| 3,597,813 | 8/1971 | Takahashi . | |
| 4,506,416 | 3/1985 | Ohminato et al. | 24/67.7 |
| 4,662,039 | 5/1987 | Richardson | 24/511 |
| 4,839,947 | 6/1989 | Cohen et al. | 24/499 |
| 4,959,892 | 10/1990 | Wang | 24/499 |

FOREIGN PATENT DOCUMENTS

| | | | |
|---|---|---|---|
| 1570080 | 6/1969 | France | 24/499 |
| 2066890 | 7/1981 | United Kingdom | 24/499 |

*Primary Examiner*—Victor N. Sakran
*Attorney, Agent, or Firm*—William L. Klima

[57] ABSTRACT

A spring biased clip comprising a pair of clamping elements hingedly connected together in combination with a spring. In a preferred embodiment, the clamping elements have hinge and spring components and are integral male and female snap connection elements which are extruded to form stock materials, which can then be out to length and assembled by a snap connection.

18 Claims, 3 Drawing Sheets

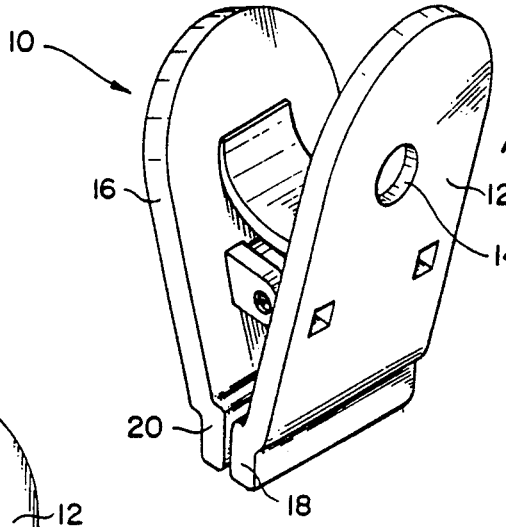
FIG. 1
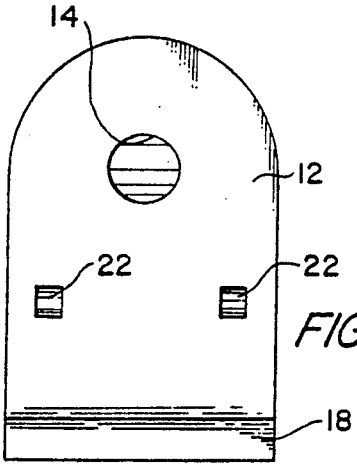
FIG. 2
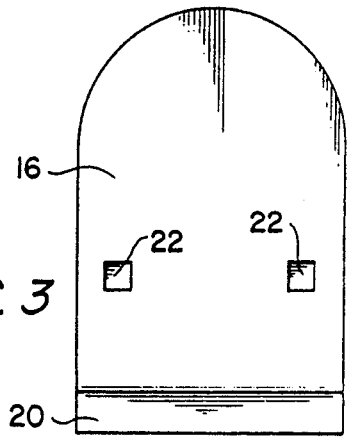
FIG. 3
FIG. 4
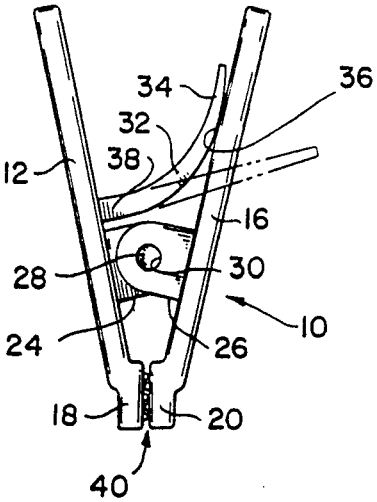
FIG. 5
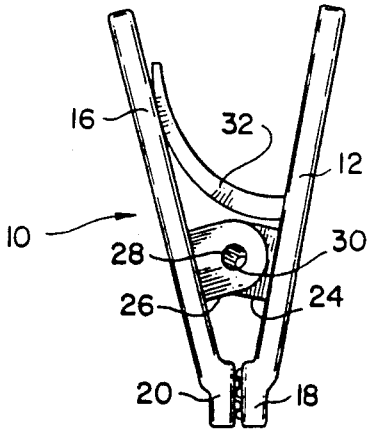
FIG. 6
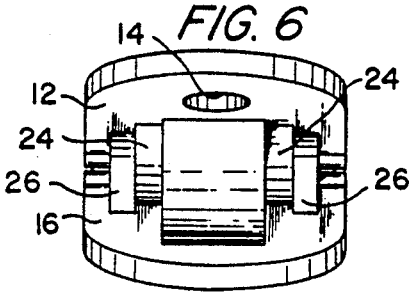
FIG. 7
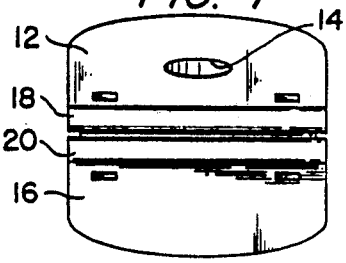

SPRING BIASED CLIP AND METHOD OF MAKING

CROSS-REFERENCE TO RELATED APPLICATIONS

This application is a continuation-in-part application of Ser. No. 07/587,029, filed Sep. 24, 1990, now U.S. Pat. No. 5,079,808.

BACKGROUND OF THE INVENTION

1. Field of the Invention

The present invention is directed to a spring biased clip. More specifically, the clip according to the present invention comprises a pair of clamping elements having interfitting components defining a hinge in combination with a spring, preferably a cantilever spring. The clip according to the present invention can take the form of a bag clip or paper clip.

2. Background of the Invention

There presently exists many varieties of bag and paper clips commercially available and in use today. However, these clips can be expensive and complex to manufacture. Specifically, there exists a need for an improved bag clip.

With respect to paper clips, by far the most highly successful clip has been the conventional bent wire paper clip. This clip has dominated the field for many years. However, this clip is not very useful for securing thick documents nor would serve as an effective bag clip. Specifically, this clip can only accommodate documents having up to approximately twenty (20) sheets due to the limitation on the amount of bending the inner wire loop can sustain at its base prior to permanent plastic deformation of the wire section located at the base.

In order to accommodate thicker documents, the conventional wire paper clip must be somewhat reformed by the fingers of the user, resulting in a clip with inadequate biasing force. The deficiency of the use of the modified conventional paper clip is further exasperated, since thicker documents require a clip with greater biasing force due to the tendency of inner sheets to slip due to an insufficient average biasing force between sheets.

Variations of the wire paper clip have from time to time been introduced, however, never gaining wide acceptance in the marketplace. Recently, a new paper clip has been introduced that is essentially a thin plate of spring steel bent into a U-shaped cross section that has gained some market share in Japan and is now on sale in the United States. In operation, the plate portions of this clip are separated apart and then the clip is slid over the document to be secured.

Another conventional clip available is designed for handling thick documents. This clip is similar to the above-described clip except edge portions of the plates forming the clip are provided with bent wire actuators. The bent wire actuators can be pivoted from one position, during use of the clip, to a clip removal position where the bent wire portions use the body of the clip itself as fulcrums for separating the plate edges by pressing the free ends of the bent wire actuators together for removing the clip. This clip is constructed of all metal, and requires a number of separate components and bending manufacturing steps of the spring steel plate and the bent wire actuators increasing the costs of manufacturing.

However, this clip is not very useful with relatively thin documents. For example, the all metal construction of this clip results in a heavy clip, which tends to bend the edge downwardly at the portion of the document to which it is applied making handling of the document during reading sometimes difficult. Further, the bulky construction of this clip tends to interfere with the fingers of the user reading the document and creates a problem when stacking or shipping a document. More specifically, this type of clip has a greater dimensional thickness than the document due to its design preventing plural documents to be stacked flatly one on top of each other, or protrudes through the side of an envelope in which it is being shipped.

SUMMARY OF THE INVENTION

An object of the present invention is to provide an improved spring biased clip.

Another object of the present invention is to provide a spring biased clip comprising two clamping elements hingedly connected together by interconnecting components of the clamping elements in combination with a spring, preferably a cantilever spring.

A further object of the present invention is to provide a spring biased clip comprising two clamping elements hingedly connected together by interconnecting components of the clamping elements.

An even further object of the present invention is to provide a spring biased clip comprising two clamping elements hingedly connected together by interconnecting components of the clamping elements, one interfitting component being defined by a male interfitting portion and the other interfitting component being defined by a female interfitting portion.

A still further object of the present invention is to provide a spring biased clip comprising two plate elements hingedly connected together by interconnecting components of the clamping elements, one interfitting component being defined by a male portion and the other interfitting component being defined by a female portion, the interfitting components cooperating together as a snap fitting.

An even still further object of the present invention is to provide a spring biased clip comprising two clamping elements hingedly connected together by interconnecting components of the clamping elements, the clamping elements having a substantially constant cross-section.

The spring biased clip according to the present invention overcomes a number of problems mentioned above with respect to conventional clips. The two piece hingedly connected construction of the clip according to the present invention allows the clip to adequately handle a wide range of document thickness. Further, the clip according to the present invention utilizes a unique construction and spring, which results in greater biasing force for documents of increasing thickness. Thus, the varying spring biasing force correlates with the actual spring biasing force required to control and maintain the sheets properly biased together to prevent individual page slippage no matter what the document thickness.

Very importantly, the construction of the spring biased clip according to the present invention lends itself to high speed and economic manufacturing and assembly. Since the clip can be made of plastic, the separate clamping elements can be injection molded with accommodating interconnecting portions and biasing spring. The spring of the clip is preferably a cantilever type spring, which can be molded extending from the inner surface of one or both clamping elements. The free end of the cantilever spring engages and cooperates with an inner surface of the opposite clamping element during operation. More specifically, the outer free end surface portion of the cantilever spring has a certain amount of curvature and engages with the inner surface of the opposite clamping element. This construction allows the cantilever spring to develop a greater biasing force due to the decreasing length of the moment arm from the base of the spring to the point of contact with the opposite clamping element.

An embodiment of the spring biased clip according to the present invention includes a pair of clamping elements having a substantially constant side cross section. Specifically, the clamping elements have a substantially uniform cross section in size and shape along the length of each clamping element. For example, the clamping elements can be machined from stock material, or preferably, can be extruded to the desired shape and size and then cut to length.

This embodiment includes a pivot arrangement for hingedly connecting the clamping elements together in combination with a spring. The spring can be provided in a number of forms including leaf and coil springs, however, a cantilever leaf spring is preferred. Preferably, the pivot and spring is formed as integral members of one or both clamping elements. For example, a cantilever spring and male/female hinge connection can be simultaneous formed by extruding the same with one or both clamping elements.

Further, the spring and hinge can be extruded to be the full length of the clamping elements to produce a stock material that can be cut to length and then assembled, or can be extruded to be a portion or portions (i.e. multiple springs or hinge portions) of the length.

The hinge connection in this embodiment is preferably in the form of a snap connection, or a connection that is simple to assembly. For example, a male and female snap connections arrangement provides a snap connection that allows the clamping elements to be easily joined by forcibly translating the element together with a sufficient force to engage the male/female portions of the snap connection. In a preferred embodiment, the clamping elements are extruded with one clamping element having a cantilever spring in combination with a male portion and the other clamping element having a female portion. Since the clamping elements are extruded, the male portions is in the form of an elongated member to be received within a female groove in the other clamping member.

The spring biased clip according to the present invention is for uses including a bag clip and paper clip. The bag clip can be used for sealing the edges of an opened plastic snack bag, for example. Typically, the upper portion of the plastic bag that is opened is folded over a couple of times and then the clip is applied to ensure a good air tight seal.

The clip according to the present invention in the format of a paper clip can accommodate various width plural sheet documents ranging from a couple of sheets to tens of sheets. The paper clip according to the present invention provides adequate biasing force in any range of typical document thickness.

BRIEF DESCRIPTION OF THE DRAWINGS

FIG. 1 is a perspective view of an embodiment of the spring biased clip according to the present invention;

FIG. 2 is a front view of the spring biased clip according to the present invention;

FIG. 3 is a back view of the spring biased clip shown in FIG. 1

FIG. 4 is a side view of the spring biased clip shown in FIG. 1;

FIG. 5 is an opposite side view of the spring biased clip shown in FIG. 4;

FIG. 6 is a top view of the spring biased clip shown in FIG. 1;

FIG. 7 is a bottom view of the paper clip shown in FIG. 1;

DETAILED DESCRIPTION OF PREFERRED EMBODIMENTS

Figure 8:
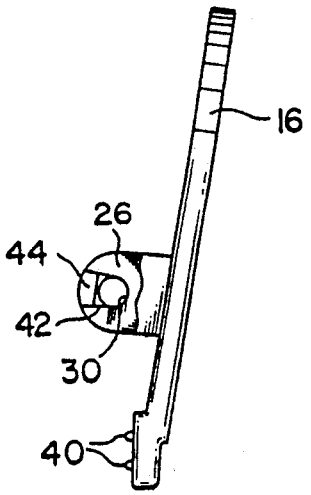
FIG. 8 is a partial side view of one of the plate elements with the closest lug partially removed to view the details of the inner surface of the other outer lug.
Figure 9:
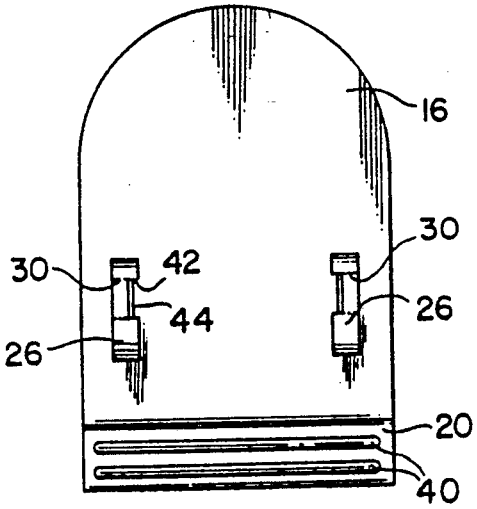
FIG. 9 is a view of the inner surface of one plate element showing the details of the outer lugs having holes therein.

A spring biased clip according to the present invention is shown in FIG. 1. The spring biased clip 10 comprises a first (clamping) plate element 12 having a thumb hole 14. The plate element 12 is pivotally or hingedly connected to a second (clamping) plate element 16. Optionally, one or both plate elements 12,16 can be provided with an additional through hole for hanging the paper clip, for example on a wall nail during use. The plate elements 12,16 are provided with clamping edges 18,20 to concentrate the application of force against the sheets of the document being clamped together.

FIGS. 2 and 3 show front and rear views of the spring biased clip 10. The plate portions may display core hole indents 22 resulting from a plastic injection molding process to form the hinge structure of the plate elements 12,16 in an integral manner.

FIGS. 4 and 5 show opposite side views of the spring biased clip 10. The plate element 12 is provided with a pair of inner hinge lugs 24. The plate element 16 is provided with a pair of outer hinge lugs 26, as shown in FIG. 6. The inner hinge lugs 24 are provided with outwardly extending bosses 28, which bosses are received or accommodated in through holes 30 in the outer hinge lugs 26 defining the hinge structure of the clip 10.

The plate portion 12 is provided with a cantilever mounted spring 32 projecting form its inner surface. The free end 34 of the spring 32 engages and cooperates with the inner surface of the plate element 16. More specifically, an outer curved surface portion 36 at or near the free end 34 of the spring 32 engages with the inner surface of plate element 16 to constantly spring bias the plates 12,16 apart. The spring 32 can be molded as an integral unit of the plate element 12 all made of plastic. Thus, the base portion 38 of the spring 32 is securely and rigidly fastened with the plate portion 12 and extends from the inner surface thereof.

Alternatively, separate cantilever springs can be provided extending from the inner surface of both plate elements 12,16 with each spring being one-half or less the width of the spring biased clip. In further alternative embodiments, a plurality of cantilever springs can extend from the inner surface of one or both plate elements 12,16 to vary the clamping power and uniformity of the clip.

During manufacture of the spring biased clip 10, the cantilever spring 32 can be molded so as to extend straight at an approximate ninety (90) degree angle from the inner surface of the plate element 12. During assembly of the plate elements 12,16 together, the cantilever spring 32 is bent in the curved shape, shown in FIGS. 4 and 5. Alternatively, the spring 12 can be molded with some initial curvature to facilitate assembly.

The cantilever spring 32 having curvature in at least the assembled spring biased clip configuration and mounted between the plate elements 12,16 provides a unique feature of the spring biased clip 10. As portions of the plate elements 12,16 above the hinge axis are pressed together, for example between a user's thumb and index finger, the lower portions of the plate elements below the hinge axis open apart to accommodate the item to be clamped such as a document.

As the upper portions of the plate elements 12,16 above the hinge axis are moved together, the spring 32 produces an increasing spring biasing force between the upper portions of these plate elements. The increasing biasing force is a result of the decreasing length of the moment arm, the length of which being defined between the base of the spring 32 to the point of contact with the spring with the inner surface of the plate portion 16. Further, the increasing curvature of the spring also produces local increasing biasing force based on the strength of materials formulations and concepts.

This particular feature results in a practical advantage in that the spring biased clip of the present invention provides a greater biasing force between the clamping edges 18,20 with increasing document thickness. The thicker the document, the greater the clamping force that is provided to prevent sheet slippage between various sheets and subsets of sheets. A greater clamping force is required due to the greater number of surface-to-surface interfaces each requiring a certain average clamping force to provide a sufficient surface frictional force between sheet surface interfaces to prevent slippage.

The inner surfaces of the clamping edge portions 18,20 can be provided with force concentration projections such as ridges 40, or pointed nodes to aid in the prevention of sheet slippage of a document. Various shapes, sizes, number of projections and material composition can be selected and tailored to a particular application such as for clamping bond paper documents verses hard manilla type sheets.

FIG. 8 is a partial side view of the plate element 16 with the closest outer hinge lug 26 partially removed to view the inner detail of the other outer hinge lug 26. Each outer hinge lug 26 is molded with a groove 42 and a ramp section 44 to facilitate the assembly of the paper clip 10. More specifically, the ramp section 44 of each outer hinge lug 26 engages with the outer tip of the boss 28 of each inner hinge lug 24 to guide the bosses 28 through the grooves 42 and into the through hole 30 of each outer hinge lug 26. Once the bosses 28 clear past the sliding surfaces of the grooves (i.e. bottoms of grooves), the bosses then snap into the through holes 3 to complete the assembly.

In an alternative assembly, the spring biased clip can be constructed to include some or all metal components. For example, spring steel strips can be stamped and bent to provide the cantilever spring extending from one plate element and hinge structure. Rivets can be used to rivet the lugs together forming the hinge structure.

Figure 10:
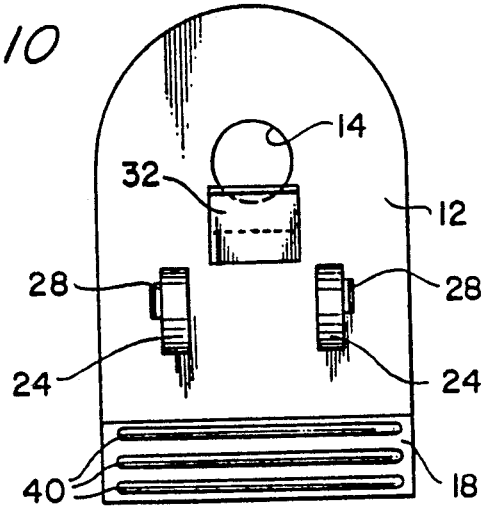
FIG. 10 is a view of the inner surface of the opposite plate element showing the details of the inner lugs having outwardly extending bosses.
Figure 11:
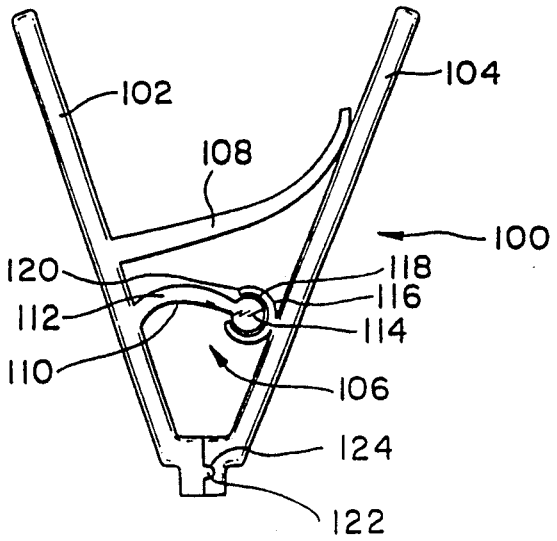
FIG. 11 is a side view of another embodiment of the clip according to the present invention.
Figure 12:
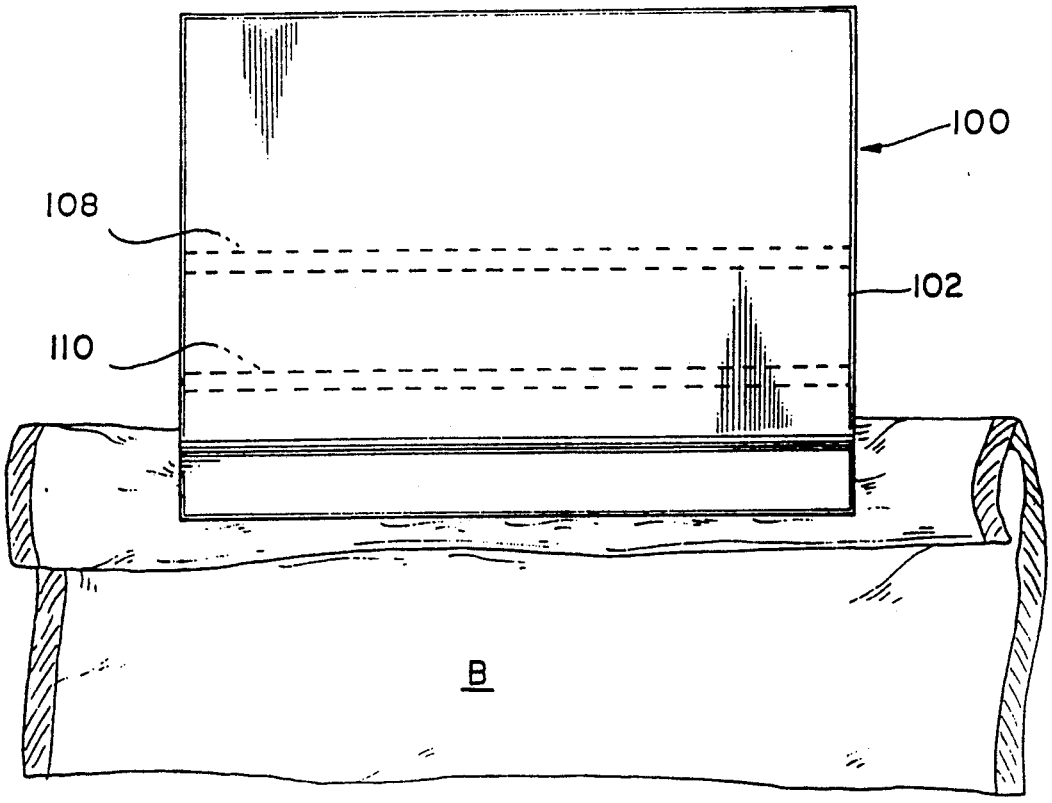
FIG. 12 is a front view of the embodiment shown in FIG. 11 clamped onto the top of a previously opened plastic snack food bag.

Another embodiment of the spring biased clip 100 according to the present invention is shown in FIG. 10. The clip 100 comprises clamping elements 102,104 hingedly connected together by hinge 106 in combination with a cantilever spring 108.

The hinge 106 comprises male portion 110 defined by a protrusion 112 extending from the rear of clamping element 102, and a male end 114 positioned at the end of protrusion 112. The hinge 106 further comprises a female portion 116 defined by a socket 118 extending from the rear of clamping element 104. The end 114 of the male portion 110 is received within the socket 118 of the female portion 116.

The hinge 106 is designed to connect the clamping elements 102,104 together during storage and operation of the clamp. However, the clamping elements could be stored disassembled. The hinge is preferably of a snap connection design in order to allow easy and quick assembly of the clamping elements. The male and female snap connections arrangement shown in FIG. 10 is the preferred snap connection arrangement that can be successfully used in this embodiment, however, other snap connection arrangements can be substituted.

In the male and female snap connections arrangement shown in FIG. 10, the protrusion 112 an end 114 of the male portion 110 form an elongated extension in the direction of extrusion. Likewise, the socket 118 of the female portion 116 forms an elongated receiving slot in the direction of extrusion. Thus, the extruded base material can be simply extruded to any length, depending on the application such as various widths plastic bags to be clamped, and then cut to the appropriate length and assembled.

The outer diameter of the male end 114 is substantially the same as the inner diameter of the socket 118. Further, the opening 120 into the socket 118 is selected to allow the male end 114 to forcibly pass through the opening 120 during assembly of the snap connection. Specifically, the dimensions of the opening are selected so that the male end 114 resiliently biases the portions of the sockets immediately positioned at the opening 120 apart to allow insertion of the male end 114 into the socket 118. Further the opening 120 is sufficiently wide to allow angular rotating of the male end 114 supported by protrusion 112 during pinching the clamp open to allow adequate pivoting.

I claim:

1. A spring biased clip, comprising:

a first clamping element having a clamping edge, said first clamping element made from a length of stock material having a substantially constant cross section;

a second clamping element having a clamping edge, said second clamping element made from a length of stock material having a substantially constant cross section;

a hinge connecting said clamping elements together, said hinge comprising a male and female snap connections arrangement; and a spring associated with the clip for biasing said clamping edges of said plate elements together, said spring defined by an integral leaf type tapered member which initially extends generally perpendicular from one of said clamping elements and in an assembled condition of the clip extends outwardly to a free end and towards the other opposite clamping element to slidably contact same along an arcuate end portion of said spring so that the clamping force of said spring will increase as said clamping edges are moved away from each other so that the clip will exert greater force on a thicker article than a thinner article.

2. A clip according to claim 1, wherein said hinge comprises an elongated protrusion having a substantially round cross section first portion extending from an inner surface of one clamping element, and another protrusion having a substantially round cross section concave portion receiving said first portion extending from an inner surface of the other clamping element defining said hinge.

3. A clip according to claim 1, wherein said stock materials are extruded.

4. A clip according to claim 1, wherein said clamping elements include interconnecting portions defining a hinge between said clamping elements.

5. A clip according to claim 4, wherein said interconnecting portions have substantially constant cross sections.

6. A clip according to claim 5, wherein said interconnecting portions are male and female connectors.

7. A clip according to claim 6, wherein said male and female connectors define an elongated element and an elongated receiving slot hinge.

8. A clip according to claim 1, wherein said spring is a cantilever spring extending from an inner side of one of said plate elements.

9. A clip according to claim 8, wherein said cantilever spring has a substantially constant cross section.

10. A device according to claim 1, wherein said spring is defined by a curved tapered cantilever spring extending from one clamping element and extending between said clamping elements, said cantilever spring having a base portion connected to the one clamping element and being thicker than a free end portion thereof, said free end portion of said cantilever spring including an outer curved surface portion slidably engaging with the other clamping element for biasing portions of said clamping elements apart while biasing said clamping edges together about said hinge.

11. A spring biased clip, comprising:

a first clamping element having a clamping edge, said first clamping element provided with a first interfitting portion, said first clamping element made from a length of stock material having a substantially constant cross section;

a second clamping element having a clamping edge, said second clamping element provided with a second interfitting portion cooperating with said first interfitting portion defining a male and female snap connection for hingedly connecting said clamping elements together, said second clamping element made from a length of stock material having a substantially constant cross section; and a cantilever spring associated with the clip for biasing said clamping edges of said clamping elements together, said spring defined by an integral leaf type tapered member which initially extends generally perpendicular from one of said clamping elements and in an assembled condition of the clip extends outwardly to a free end and towards the other opposite clamping element to slidably contact same along an arcuate end portion of said spring so that the clamping force of said spring will increase as said clamping edges are moved away from each other so that the clip will exert greater force on a thicker article than a thinner article.

12. A spring according to claim 11, wherein said snap connection is defined by a male and female connections hinge.

13. A clip according to claim 12, wherein said male and female connections hinge comprises an elongated protrusion having a substantially round cross section first portion extending from an inner surface of one clamping element, and another elongated protrusion having a substantially round cross section concave portion receiving said first portion extending from an inner surface of the other clamping element defining said hinge.

14. A clip according to claim 11, wherein said cantilever spring protrudes from an inner side of one plate element and said interfitting portions of said clamping elements are male and female connectors.

15. A clip according to claim 14, wherein said male connector extends from the inner side of one clamping element and said cantilever spring extends from the inner side of the same clamping element.

16. A clip according to claim 15, wherein said male and female connectors are positioned between said cantilever spring and said clamping edges of said clamping elements.

17. A clip according to claim 14, wherein said male and female connectors are positioned between said cantilever spring and said clamping edges of said clamping elements.

18. A device according to claim 11, wherein said cantilever spring is defined by a curved tapered cantilever spring extending from one clamping element and extending between said clamping elements, said cantilever spring having a base portion connected to the one clamping element and being thicker than a free end portion thereof, said free end portion of said cantilever spring including an outer curved surface portion slidably engaging with the other clamping element for biasing portions of said clamping elements apart while biasing said clamping edges together about said hinge.

* * * * *